United States Patent [19]

Nash et al.

[11] Patent Number: 4,839,481

[45] Date of Patent: Jun. 13, 1989

[54] VACUUM INTERRUPTER

[75] Inventors: William H. Nash, South Milwaukee; Ernest F. Bestel, Franklin, both of Wis.

[73] Assignee: Cooper Industries, Inc., Houston, Tex.

[21] Appl. No.: 156,251

[22] Filed: Feb. 16, 1988

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,553,003 | 11/1985 | Cherry | 200/144 B |
| 4,629,839 | 12/1986 | Falkingham | 200/144 B |
| 4,704,506 | 11/1987 | Kurosawa et al. | 200/144 B |
| 4,717,797 | 1/1988 | Hoene | 200/144 B |

*Primary Examiner*—Robert S. Macon

*Attorney, Agent, or Firm*—Nelson A. Blish; Eddie E. Scott; Alan R. Thiele

[57] ABSTRACT

A cylindrical coil electrode (10) incorporated in a vacuum interrupter comprises a cylindrical body (12) having an opening at one end thereof, three electrical connectors (16) provided between the edge surface (15) of the opening of the cylindrical body and a main electrode (11). A second cylindrical coil electrode having slits parallel to said first cylindrical coil electrode is mounted in an opposing manner. Because of the above structure, one-turn current flow throughout the current paths so that a uniform axial magnetic field is applied to the main electrode, and an arc current can be uniformly distributed over the entire surface of the main electrode, thereby improving the current interruption performance of the vacuum interrupter.

6 Claims, 2 Drawing Sheets

VACUUM INTERRUPTER

BACKGROUND OF THE INVENTION

This invention relates to a vacuum interrupter including an improved cylindrical coil electrode.

A vacuum interrupter for interrupting a large current includes generally a pair of main electrodes disposed in a vacuum vessel so as to be movable toward and away from each other, coil electrodes mounted on the rear surfaces of the main electrodes, and rods extending to the exterior of the vacuum vessel from the rear surfaces of the coil electrodes. Current flows from one of the rods to the other through the coil electrodes and main electrodes. When one of the rods is urged by an actuator for interrupting the current, one of the main electrodes moves away from the other main electrode, and an arc current is generated to flow across the two main electrodes. This arc current is dispersed into filament-like arc currents by the magnetic field.

Such a coil electrode is disclosed in, for example, U.S. Pat. No. 3,946,179. In the coil electrode disclosed arms, connected at one end to a rod, extend in a radial direction to connect at the other end thereof to one end of arcuate sections respectively, and the arcuate sections extend in a circumferential direction to be electrically connected to the other end thereof to a main electrode. Thus, an arm and an associated arcuate section constitute a so-called L-shaped conductive member. Four L-shaped conductive members are mounted to the rod, and a clearance is formed between the adjacent ones of the four arcuate sections arranged in a circular pattern.

Current flows through the coil electrode via the route of the rod-arms-arcuate sections to the main electrode. Because of the presence of the clearances, the current flows through the four arcuate sections in the same direction, that is, the current flows substantially through an imaginary coil of one turn. This one-turn current produces a uniform axial magnetic field which acts to produce diffuse arc current flowing across the main electrodes.

Thus, the clearances present in the known coil electrode play an important role for generation of a uniform axial magnetic field in the arcuate sections. In spite of such a great effect exhibited by the clearances, the known coil electrode is defective in that the axial magnetic field is weak in the vicinity of the clearances. Generally, an arc current has such a tendency that it migrates from a low intensity portion toward a high intensity portion of an axial magnetic field. Therefore, the arc current flowing through the portions of the main electrode near the clearances migrates toward the central area of the main electrode where the intensity of the axial magnetic field is high, and concentration of the arc current to the central area of the main electrode having the high field intensity results in localized overheating of the main electrode, thereby degrading the capability of current interruption. Since, also, the entire area of the main electrode cannot be effectively utilized for the current interruption, it becomes necessary to increase the size of the main electrode.

SUMMARY OF THE INVENTION

A small-sized vacuum interrupter according to the present invention is provided which operates with an improved current interruption performance. A coil electrode incorporated in a preferred embodiment of the vacuum interrupter according to the present invention comprises a cylindrical body having an opening at one end thereof, a plurality of electrical connections provided between the edge surface of the opening of the cylindrical body and a main electrode, at least two inclined slits formed on the cylindrical body between each of the electrical connections to a rod. Two substantially identical coil electrodes are incorporated so that the inclined slits on each of the opposing coil electrodes are essentially parallel. Because of the above structure, one-turn current flows throughout the current paths so that a uniform axial magnetic field is applied to the main electrode, and an arc current can be uniformly distributed over the entire surface of the main electrode, thereby improving the current interruption performance of the vacuum interrupter.

DETAILED DESCRIPTION OF THE INVENTION

Figure 1:
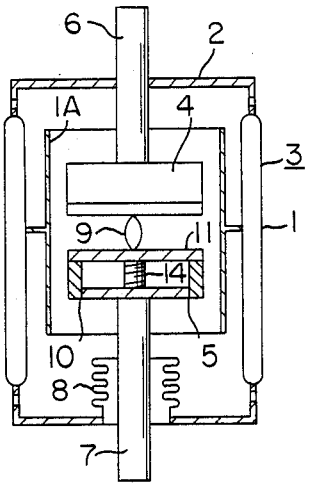
FIG. 1 is a partly sectional, schematic side elevation view of a preferred embodiment of the vacuum interrupter according to the present invention.

One embodiment of the vacuum interrupter according to the present invention will be explained with reference to FIG. 1. Shown in FIG. 1, a vacuum vessel 3 is formed by mounting a pair of end plates 2 on both ends of a cylindrical member 1 of an electrical insulating material. A stationary electrode 4 and a movable electrode 5 are disposed opposite to each other in the vacuum vessel 3, and a pair of rods 6 and 7 extend to the exterior of the vacuum vessel 3 from the rear surfaces of these electrodes 4 and 5 respectively. A bellows 8 is mounted between one of the rods or the rod 7 and the associated end plate 2. The bellows 8 acts to drive an actuator, not shown, mounted on the rod 7 so as to permit movement of the rod 7 in its axial direction. When the rod 7 is urged in its axial direction, the movable electrode 5 is electrically moved away from the stationary electrode 4, and an arc current 9 generated between these two electrodes 4 and 5 produces metal vapor.

The metal vapor attached to an intermediate shield 1A supported in the insulating cylindrical member 1, and the arc is extinguished by being dispersed by a magnetic field generated in the axial direction of a cylindrical coil electrode 10. This cylindrical coil electrode 10 is provided in each of the stationary and movable electrodes 4 and 5. Herein, the cylindrical coil electrode 10 provided in the moveable electrode 5 will be explained with reference to FIG. 2. The cylindrical coil electrode 10 is essentially identical to electrodes 4 and 5.

Figure 2:
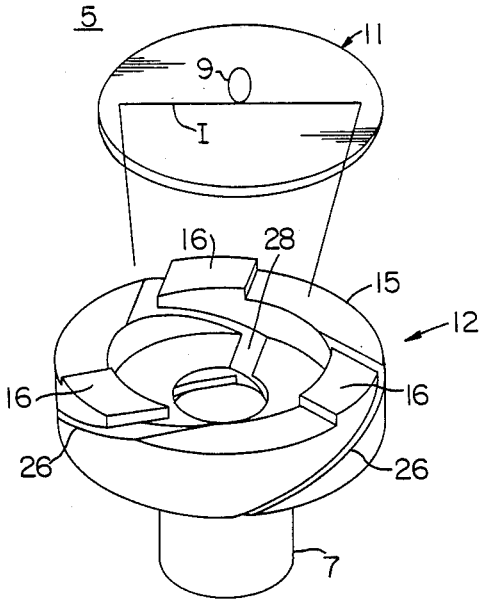
FIG. 2 is a perspective view of electrode incorporation in the vacuum interrupter shown in FIG. 1.
Figure 3:
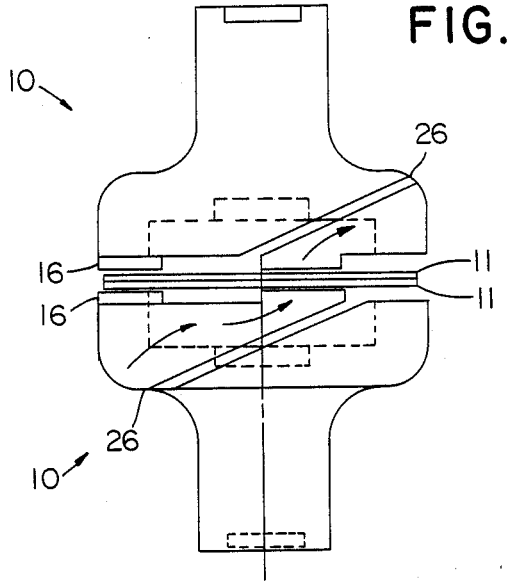
FIG. 3 is a side view partially in phantom of two opposed cylindrical electrode according to the present invention.
Figure 4:
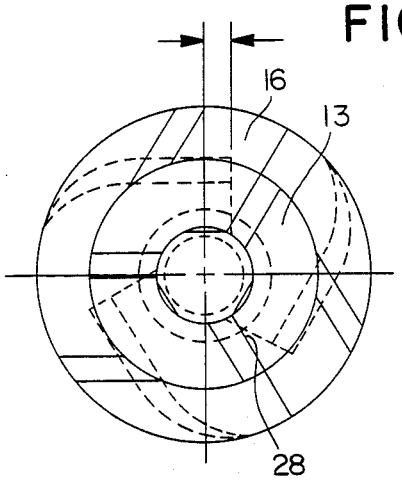
FIG. 4 is a top view partially in phantom of a cylindrical electrode according to the present invention.

Referring to FIGS. 2–4, the cylindrical coil electrode 10 is mounted to the rear surface of a main electrode 11 and includes a cylindrical body 12 having an opening at one end and a closed bottom 13 at the other end. A spacer 14 made of a high resistance material, for example, a stainless steel, is disposed between the main electrode 11 and the bottom 13 of the cylindrical body 12. Projections 16 are formed on the end edge surface 15 of the opening of the cylindrical body 12, and the main electrode 11 is electrically connected to the projection 16. Projection 16 may be formed on the main electrode. Inclined slits 26 are formed at positions of the cylindrical body 12. One end of each of the inclined slits 26 extends from the end edge surface 15 of the opening of the cylindrical body.

The inclined slit 26 may be replaced by a stepped slit or by a member of a high resistance material, for example, a stainless steel. The requirement is that current flowing from the input end toward the output end of one of the current paths can be separated from current flowing from the input end toward the output end of the other current path, so that current of one turn of an imaginary coil can flow throughout the current paths.

An electrical coil such as described above is mounted on both main electrical contacts. An essential feature of the invention is that the inclined slits 26 are approximately parallel to each other. As shown in FIG. .3, opposed cylindrical coil electrodes 10 are mounted opposed to each other so that projections 16 of opposite electrodes will be directly opposite one another. In this position, it is seen that inclined slits 26 for the opposed electrodes will be offset. Thus, functionally, currently flowing in one direction, for example, from the bottom coil electrode on the left, will flow up, as indicated by arrows, through projection 16, both main electrodes 11, and through projection 16 for the top coil electrode.

In operation, when the movable electrode 5 is parted away from the stationary electrode 4 to interrupt the current flow, an arc current 9 flows across the two electrodes 4 and 5. As shown by the arrows, the arc current 9 flows through the projection 16 and flows then into the rod 7 through the bottom 13 of the cylindrical body 12.

It will be seen from the above description of the present invention the current flowing into and flowing out is equivalent to current flowing through one turn of an imaginary coil. Thus, an axial magnetic field H produced by such a current is uniformly applied over the entire surface of the main electrode 11, and the arc current 9 is uniformly distributed over the entire surface of the main electrode 11. Therefore, the current interruption performance can be improved, and the vacuum interrupter can be reduced in its overall size because of the capability of effective utilization of the entire surface of the main electrode for current interruption.

In the aforementioned embodiments three projections 16 are provided on the cylindrical body 12. However, provision of more than two projections, for example, four, six or more projections can further reduce the overall size of the vacuum interrupter, because current is further dispersed to prevent localized overheating at the projections.

Further, the intensity of an eddy current generated by a magnetic field produced by current flowing through the bottom 13 of the cylindrical body 12 is limited by the presence of the slits 28, and the resultant magnetic flux is not strong enough to cancel the axial magnet field H. Therefore, an undesirable intensity reduction of the axial magnetic field H can be prevented. In this connection, provision of more slits 28 can further prevent an undesirable reduction of the intensity of the axial magnetic field H.

It will be understood from the foregoing descriptions that the present invention can provide a small-sized vacuum interrupter operable with an improved current interruption performance.

We claim:

1. A vacuum interrupter, comprising:

at least one pair of substantially disk-shaped main electrodes disposed in a vacuum vessel so as to be movable toward and away from each other, said main electrodes generating an arc current when moved away from each other;

rods extending out of said vacuum vessel from rear surfaces of said main electrodes, respectively; and a cylindrical coil electrode means electrically connected between the rear surface of both of said main electrodes providing an axial magnetic field to diffuse the arc current between said main electrodes, said cylindrical coil electrode means including:

a cylindrical body having a first opening at a first end, and a central opening at a second end, said first end electrically connected to said main electrode, and said second end electrically connected to said rod;

a plurality of electrical connections provided between an edge surface along the first opening of said cylindrical body and said main electrodes;

a plurality of inclined slits communicating at one end thereof with the central opening at the second end of said cylindrical body and said slits extending to the edge surface of said cylindrical body;

wherein the inclined slits on the first cylindrical coil electrode means are generally parallel to the inclined slits on the second cylindrical coil electrode means attached to the other of said pair of said main electrodes.

2. A vacuum interrupter as in claim 1 wherein said rods and said cylindrical coil electrodes are one piece construction.

3. A vacuum interrupter as in claim 1 wherein said disk-shaped main electrodes are solid.

4. A vacuum interrupter as in claim 1 wherein said slits extend into a flat base portion of said cylindrical coil electrode.

5. A vacuum interrupter as in claim 4 wherein said slits are tangiential to a cup-shaped depression in said base portion of said cylindrical coil electrode means.

6. A vacuum interrupter as in claim 1, wherein said slits define a current path of at least one full turn about the combined length of said first and second cylindrical coil electrode means.

* * * * *